United States Patent [19]

Kato

[11] Patent Number: 4,638,731

[45] Date of Patent: Jan. 27, 1987

[54] PRESS MACHINE

[75] Inventor: Heizaburo Kato, Shizuoka, Japan

[73] Assignee: Sankyo Manufacturing Co., Ltd., Tokyo, Japan

[21] Appl. No.: 789,276

[22] Filed: Oct. 18, 1985

[30] Foreign Application Priority Data

Jun. 14, 1985 [JP] Japan ..... 60-89827[U]
Jun. 14, 1985 [JP] Japan ..... 60-89828[U]
Jun. 14, 1985 [JP] Japan ..... 60-89829[U]

[51] Int. Cl.[4] ..... B30B 1/06

[52] U.S. Cl. ..... 100/282; 72/452; 74/55; 83/628; 100/292

[58] Field of Search ..... 100/282, 292; 72/452; 83/628; 74/55

[56] References Cited

U.S. PATENT DOCUMENTS 1,091,098 3/1914 Valiquet .
2,387,421 10/1945 Bergh ..... 74/55
2,759,366 8/1956 Reid ..... 74/55
2,857,968 10/1958 Cousino .
3,768,359 10/1973 Koefferlein ..... 83/628 X
3,785,194 1/1974 Bradlee ..... 72/452 X

FOREIGN PATENT DOCUMENTS 474206 9/1925 Fed. Rep. of Germany .
1857738 8/1962 Fed. Rep. of Germany .
2454959 11/1974 Fed. Rep. of Germany .
728837 7/1932 France .

OTHER PUBLICATIONS

Page 52 from book entitled "*Getriebetechnik*", 1930 by H. J. Knab.

*Primary Examiner*—Billy J. Wilhite
*Attorney, Agent, or Firm*—Pollock, Vande Sande & Priddy

[57] ABSTRACT

A press machine has a frame; a horizontal input shaft rotatably carried by the frame and rotationally driven by a driving system; a cam means including at least one cam mounted on the input shaft; a cam follower means including a cam follower slide embracing the cam and mounted on the frame for free vertical movement, the cam follower slide being adapted to be moved reciprocatingly up and down in accordance with the rotation of the cam; a movable die portion fixed to the lower end of the cam follower slide; and a stationary die portion provided on the bottom of the frame for cooperation with the movable die portion. The cam has a contour which approximates a spherical regular polygon such as a spherical triangle, having 2n+1 apices (n being an integer) which are rounded, the surfaces of the sides of the spherical regular polygon being formed by the same curve.

5 Claims, 6 Drawing Figures

PRESS MACHINE

BACKGROUND OF THE INVENTION

1. Field of the Invention

The present invention relates to a press machine which is actuated mechanically and, more particularly, to an improvement in the press machine which is driven by means of a cam.

2. Description of the Prior Arts

In conventional press machines of the type actuated mechanically by means of a crank or a cam, the slide makes only one reciprocating cycle per one rotation of the input shaft. Therefore, an increase of operation speed of the press machine is possible only through an increase in the rotation speed of the input shaft. An increase rotation speed of the input shaft, however, shortens the life of the press machine due to various reasons such as fatigue of the bearings, influence of inertia and so forth and, in addition, impairs the working precision undesirably.

This type of press machine also encounters a problem concerning the difficulty in attaining the mass balance of rotary parts, because of an offset of the throw from the input shaft axis in case of a crank type machine and offset of cam from the same in case of the cam type machine.

As a measure for attaining a dynamic balance of the slide and die set attached to the slide during movement of the slide and the die set, it has been proposed to attach a balance wheel to the crankshaft or to provide an eccentric mass in symmetry with the eccentricity of the crank such that the mass is swung in the direction counter to the direction of movement of the slide. In the conventional press machine, however, a dynamic unbalance is produced also in the direction other than the direction of movement of the slide, because the eccentric mass is provided for rotation about the axis of rotation of the input shaft. This dynamic unbalance imparts to the machine frame a vibration which is not negligible, particularly in the case of a high-speed press.

SUMMARY OF THE INVENTION

Accordingly, an object of the invention is to provide a mechanically actuated press machine which ensures a high working precision by virture of good dynamic balance of rotary mass, thereby overcoming the above-described problems of the prior art.

To this end, according to the invention, there is provided a press machine comprising: a frame; a horizontal input shaft rotatably carried by the frame and rotationally driven by a driving system; a cam means including at least one cam mounted on the input shaft; a cam follower means including a cam follower slide embracing the cam and mounted on the frame for free vertical movement, the cam follower slide being adapted to be moved reciprocatingly up and down in accordance with the rotation of the cam; a movable die portion fixed to the lower end of the cam follower slide; and a stationary die portion provided on the bottom of the frame for cooperation with the movable die portion; wherein the cam has a contour which approximates a spherical regular polygon having $2n+1$ apices (n being an integer) which are rounded, the surfaces of the sides of the spherical regular polygon being formed by the same curve.

These and other objects, features and advantages of the invention will become clear from the following description of the preferred embodiment when the same is read in conjunction with the accompanying drawings.

DESCRIPTION OF THE PREFERRED EMBODIMENTS

Preferred embodiments of the invention will be described hereinunder with reference to the drawings.

Figure 1:
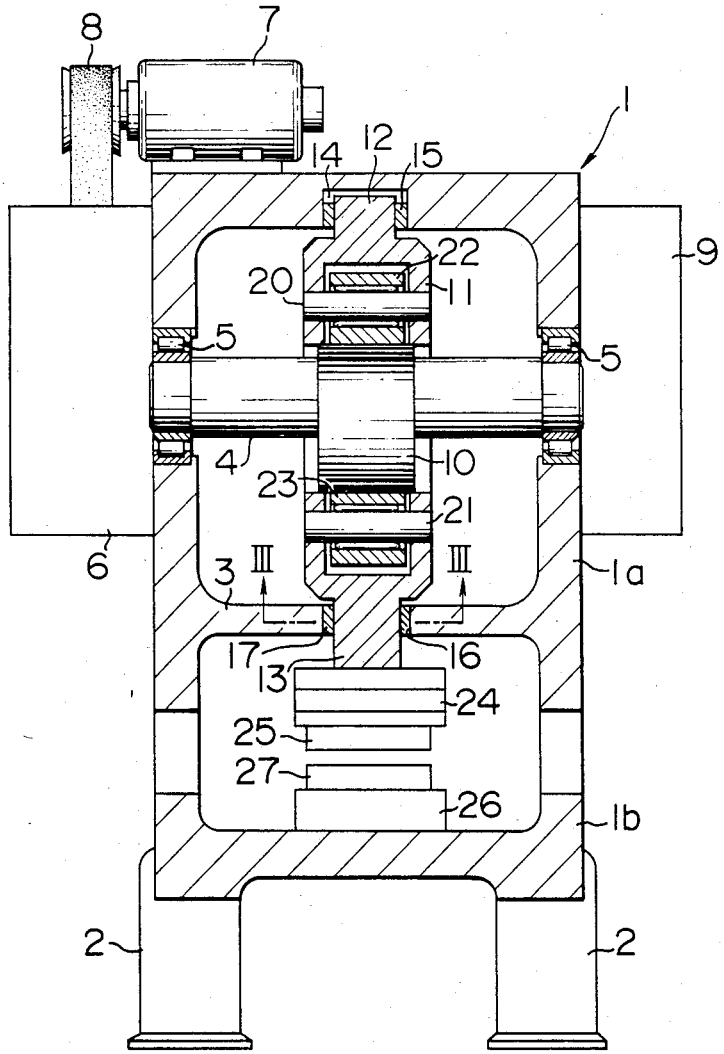
FIG. 1 is a vertical sectional view of a first embodiment of the press machine in accordance with the invention.
Figure 2:
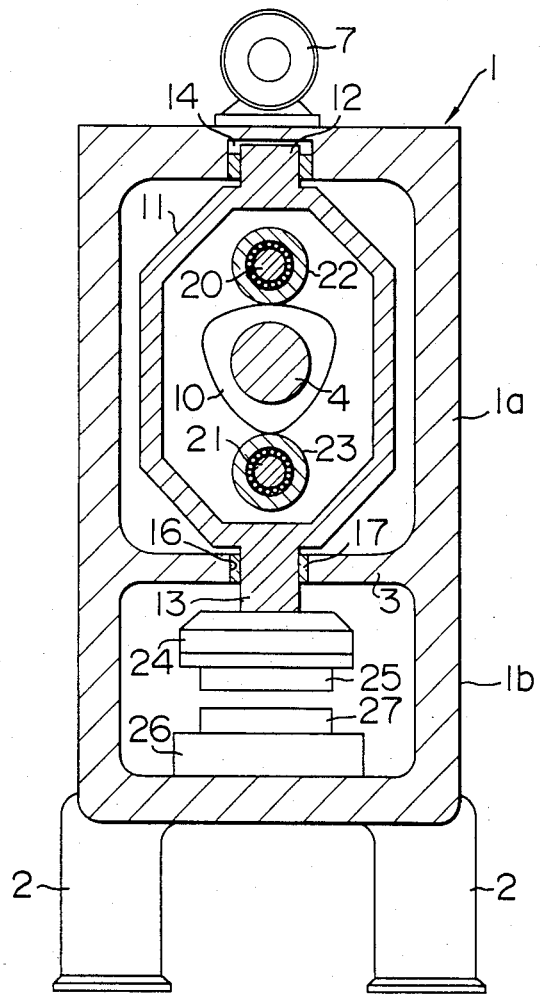
FIG. 2 is a sectional view of the embodiment shown in FIG. 1 taken along a plane which is perpendicular to the plane of section of FIG. 1.
Figure 3:
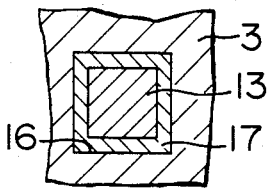
FIG. 3 is a fragmentary cross-sectional view taken along the line III—III of FIG. 1.

FIGS. 1 to 3 show a cam type press machine as a first embodiment of the invention. Referring first to FIGS. 1 and 2, the cam-type press machine has a frame 1 which is situated on a stationary plane such as floor surface by means of pillars 2. The frame 1 is provided substantially at its mid portion with a partition wall 3 which separates the frame 1 into two parts: namely, an upper part which constitutes a crown portion 1*a*, i.e., an actuating section and a lower base portion 1*b*, i.e., a working section.

An input shaft 4 extends horizontally across the upper actuating section 1*a* of the frame 1. The input shaft 4 is rotatably supported by means of bearings 5 mounted on the frame 1. The input shaft 4 is connected at its one end, e.g., at the left end as viewed in FIG. 1, to a clutch device 6 attached to one side of the frame 1. Although not shown, the clutch device 6 is composed of an ordinary clutch and a clutch wheel. The clutch wheel is drivingly connected through a belt 8 to an electric motor 7 which is mounted on the top of the frame 1. The electric motor 7, belt 8 and the clutch device in combination constitute a driving system. The other end, e.g., right end as viewed in FIG. 1, is connected to a braking device 9 fixed to the other side of the frame 1. With this arrangement, it is possible to selectively drive and stop the input shaft 4 without stopping the electric motor 7, by a suitable control of the clutch device 6 and the brake device 9. A cam 10 having a spherical triangular shape with rounded apices is provided on a substantially mid portion of the input shaft 4, within the actuating portion 1*a* of the frame 1. The cam 10 may be formed integrally with the input shaft 4 or may be formed separately from the input shaft 4 and then fitted to the same. Although the cam 10 in the described embodiment has a spherical triangular form with rounded apices, such a form of the cam is not exclusive. Namely, the cam 10 can have any desired spherical polygonal shape with rounded apices, provided that the number of apices is expressed by $2n+1$, where n represents an integer, and that all the sides of the polygon are generated by the same curve. Thus, in the illustrated case, the integer n is "1", so that the number of apices is given as $2\times1+1=3$.

A hollow cam follower slide 11 is mounted such as to embrace the cam 10 on the input shaft 4. The slide 11 has a short hub 12 extending upwardly therefrom and an actuating shaft 13 projected downwardly therefrom.

The short hub 12 is received in a recess 14 formed in the inner surface of the top of the crown portion 1*a* of the frame 1 and is slidably supported by a metal 15. The actuating shaft 13 extends past a through hole 16 formed in the partition wall 3 of the frame 1 into the base portion of the frame, i.e., into the working section 1*b* and is slidably supported by a metal 17 mounted in the through hole 16. The recess 14 and the through hole 16 are coaxial with each other so that the slide is supported on the frame 1 vertically slidably. As will be seen from FIG. 3, the actuating shaft 13 projecting downwardly from the slide 11 can have a square cross-section. Similarly, the through hole 16 and, hence, the metal 17 can have square cross-sections. With such an arrangement, it is possible to prevent the slide 11 from rotating about an axis perpendicular to the axis of the input shaft 4, thus protecting the cam and the slider against any abnormal force. This, however, is not essential and the slide 11 and the metal 17 can have circular cross-sections.

The slide 11 has a pair of rollers 22 and 23 rotatably carried by shafts 20 and 21 which are vertically spaced from each other. These rollers 22 and 23 are arranged to be kept in contact with the cam 10 on the input shaft 4. Therefore, the slide 11 is positioned in the top dead center of its stroke when one of the protrusions or the apices of the cam 10 is brought to the uppermost position and in the bottom dead center of its stroke each time the mid point between adnacent apieces of the cam 10 is brought to the uppermost position during rotation of the cam 10. Thus, the slide 11 is driven reciprocatingly in accordance with the rotation of the cam 10.

A slide 24 of an ordinary construction, different from the cam follower slide 11 mentioned above, is fixed to the lower end of the actuating shaft 13 projecting downwardly from the slide 11. The slide 24 supports a movable die portion 25 which performs a press work in the manner known per se in cooperation with a stationary die 27 fixed to a bolster 26 which in turn is fixed to the inner bottom surface of the base portion 1*b* of the frame.

As will be clear from the foregoing description, according to the invention, the cam on the input shaft has a form which approximates a regular polygon having $(2n+1)$ apices (n being an integer), so that the number of strokes of the press per rotation of the input shaft is increased. According to the invention, therefore, the number of press cycles is increased without requiring increase in the rotation speed of the input shaft.

This advantageous effect will be explained in more detail. In the described embodiment, the cam follower slide includes a pair of rollers which are kept in contact with the cam, and the cam has three apices, i.e., the integer n is "1". In this case, the cam follower slide 11 is in the top dead center of its stroke when the upper roller on the slide is contacted by one of the apices of the cam while the lower roller is contacted by a mid point between two adjacent apices of the cam. When a mid point between two adjacent apices contacts the upper roller while one of the apices is in contact with the lower roller, the slide is in the bottom dead center of its stroke. One stroke of the slide is completed when the slide has been moved from the top dead center to the bottom dead center and then again to the top dead center. Thus, one stroke of the slide is performed while the cam is rotated from a position at which one of the apices is held in contact with the upper roller to a position at which the next apices as viewed in the direction of rotation of the cam is brought into contact with the upper roller. Therefore, the cam follower slide makes $2n+1$ strokes per one rotation of the input shaft. Thus, when the cam has three apices as in the case of the described embodiment, the cam follower slide makes 3 (three) strokes per one rotation of the input shaft. In consequence, the movable die fixed to the lower end of the slide performs corresponding number of press cycles in cooperation with the stationary die.

In the conventional press machine with a cam which does not have contour approximating a regular polygon, the slide makes only one stroke per one rotation of the input shaft, unlike the press machine of the invention.

Representing the moment of inertia in this conventional press machine by $I_1$, the moment of inertia $I_3$ in the press machine of the invention, when the integer n is "1", is given by the following formula, because the rotation of the input shaft is one third of that in the conventional press machine.

$$I_3=I_1(\tfrac{1}{3})^2\times360°/120°=I_1\tfrac{1}{3}$$

Similarly, the moment of inertia $I_5$ when the integer n is "3" is given as $I_5=I_1 1/5$. Thus, in the press machine of the invention, the moment of inertia $I_{2n+1}$ takes a small value which is expressed by $I_{2n+1}=I_1 1/2n+1$. Thus, the slide driving apparatus of the invention is suited to a high-speed operation.

In addition, the cam incorporated in the press machine of the invention, having a contour approximating a regular polygon with $2n+1$ apices, provides a better balance of rotation as compared with the cam in the conventional machine having only one apex.

In the illustrated embodiment of the invention, the cam follower slide 11 has a short hub 12 projecting upward from the top thereof and the actuating shaft 13 projecting downward therefrom. The hub 12 and the actuating shaft 13 are supported vertically slidably by means of the metals 15 and 17 provided on the frame. According to this arrangement, the cam follower slide is supported at two points which are vertically spaced by an ample distance, i.e., at the positions of the metals 15 and 17, so that the sliding motion of the cam follower slide is smoothed to enhance the working precision of the press machine. In other words, the smooth vertical sliding motion of the cam follower slide will not be obtained if the vertical span of support of the cam follower slide is small.

Figure 4:
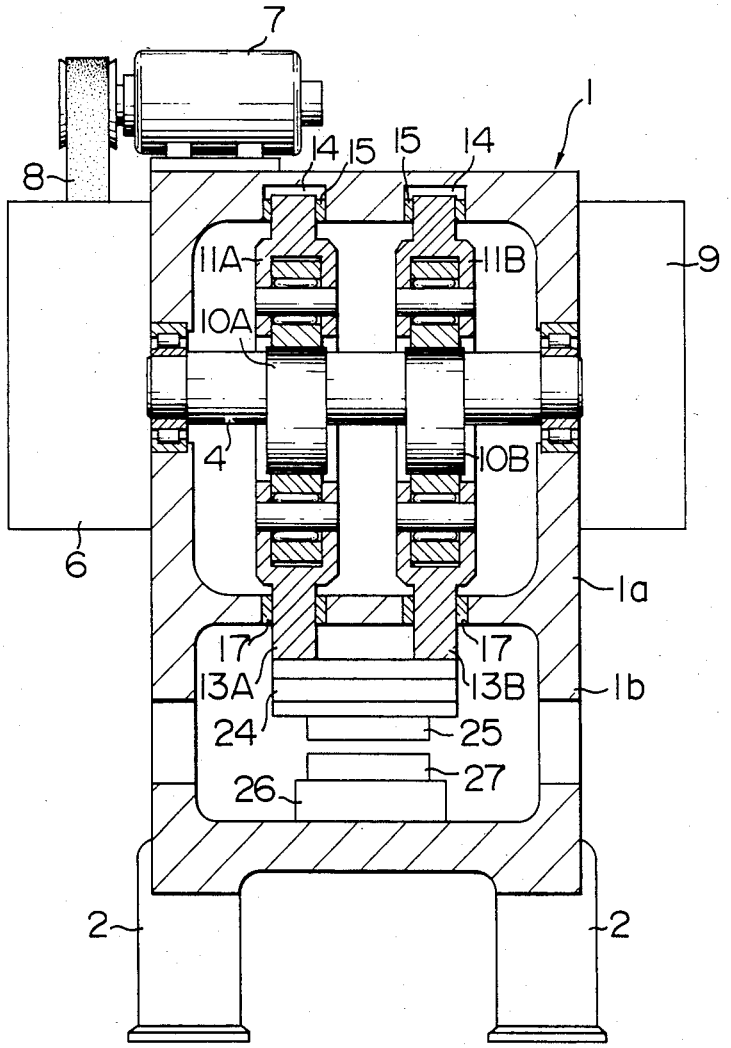
FIG. 4 is a view similar to that in FIG. 1, showing a second embodiment of the press machine in accordance with the invention.

FIG. 4 shows a second embodiment of the invention in which the same reference numerals are used to denote the same parts or members as those appearing in FIGS. 1 to 3. In this embodiment, a pair of cams 10A and 10B are mounted on the same input shaft 4 leaving a suitable axial gap therebetween. Each of the cams 10A and 10B has the same construction as the cam 10 of the first embodiment. Cam follower slides 11A and 11B are combined with respective cams 10A and 10B. Each of the cam follower slides 11A and 11B has the same construction as the cam follower slide 11 in the preceding embodiment, and is supported vertically slidably by metals 15 and 17. The lower ends of the actuating shafts 13A, 13B projecting downwardly from the cam follower slides 11A, 11B are connected to a common slide 24 which supports the movable die 25. Portions of the second embodiment other than specifically mentioned above are materially identical to those in the first embodiment. It will be seen that the arrangement of the second embodiment can enhance the rigidity of the mechanism for driving the slide 24, thus ensuring a smooth movement of the slide 24.

Figure 5:
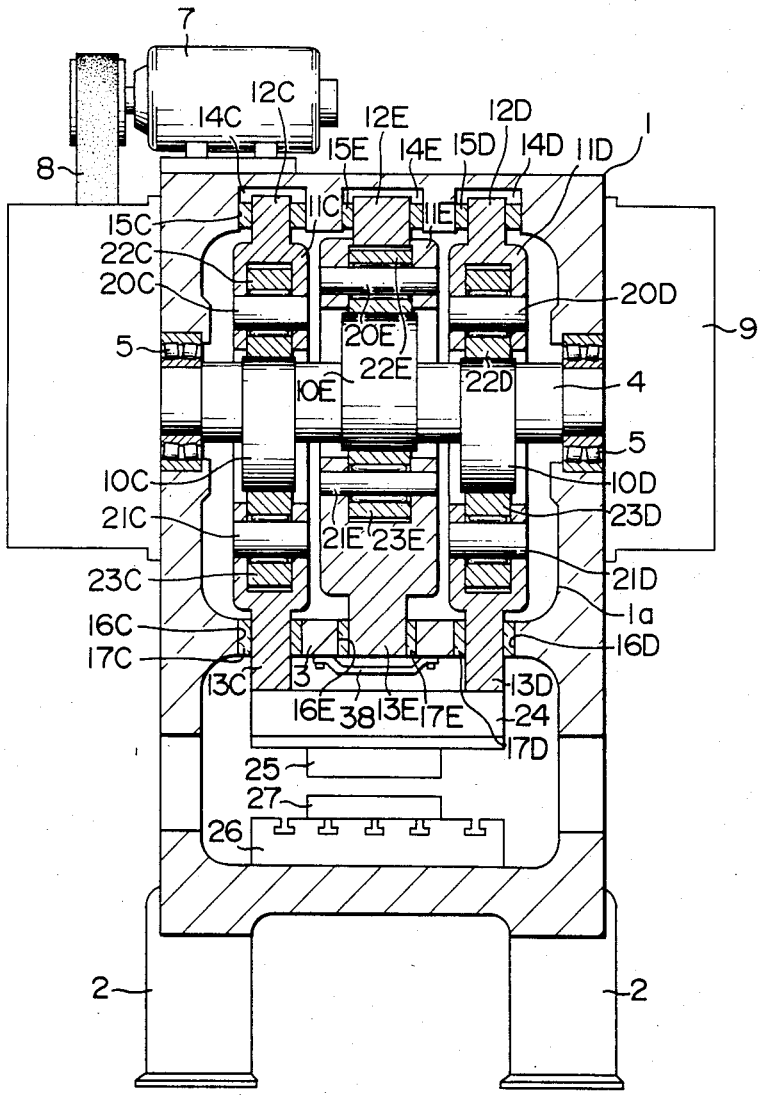
FIG. 5 is a vertical sectional view of a third embodiment of the press machine in accordance with the invention.
Figure 6:
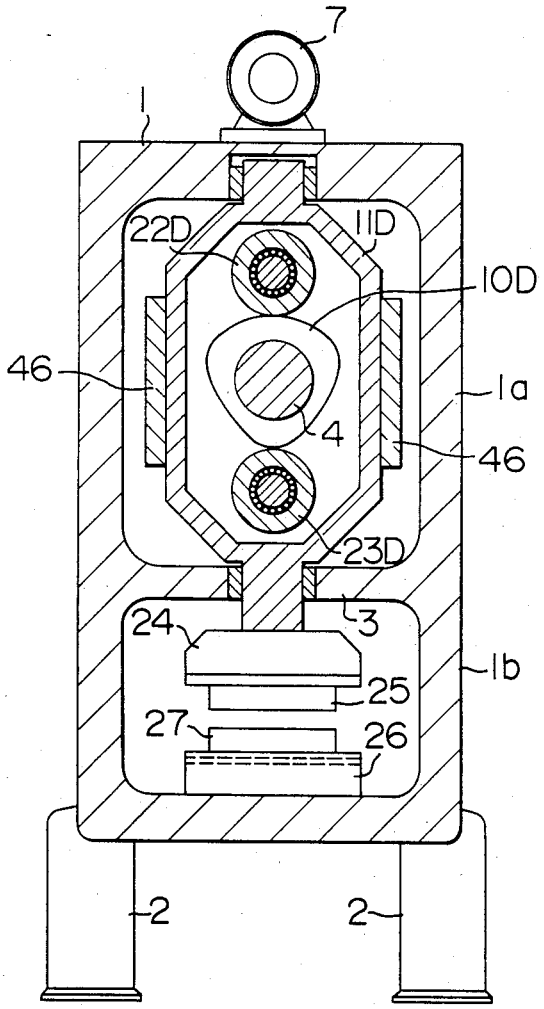
FIG. 6 is a vertical sectional view of the embodiment shown in FIG. 5, taken along a plane perpendicular to the plane of the sheet of the drawing.

FIGS. 5 and 6 show a third embodiment of the invention in which the same reference numerals are used to denote the same parts or members as those appearing in FIGS. 1 to 3.

The third embodiment of the invention employs three cams mounted on the same input shaft 4, i.e., a first cam 10C, a third cam 10E and a second cam 10D from the left to the right. These cams 10C to 10E may be formed integrally with the input shaft or, alternatively, formed independently and then fixed to the input shaft. Each of the cams 10C to 10D has a construction similar to the cam 10 in the first embodiment, but phase differences are formed between these cams 10C, 10D and 10E.

First, second and third hollow cam follower slides 11C, 11D and 11E are provided in such a manner as to embrace corresponding cams 10C, 10D and 10E. Each of the cam follower slides 11C to 11E is of the same type as the cam follower slide 11 in the first embodiment. Thus, the cam follower slides 11C, 11B and 11D have short hubs 12C, 12D and 12E projecting upward therefrom and actuating shafts 13C, 13D and 13E projecting downwardly therefrom. The short hubs 12C, 12D and 12E project into recesses 14C, 14D and 14E formed in the inner surface of the top wall of the frame 1 and slidably supported by respective metals 15C, 15D and 15E. On the other hand, the actuating shafts 13C and 13D on the first and second cam follower slides 11C and 11D extend downwardly into the base portion 1*b*, i.e., the working section, through respective through holes 16C and 16D which are formed in the partition wall 3. The lower ends of these actuating shafts are connected to the actuating slide 24 which supports the movable die 25. The movable die 25 is adapted to perform a press work in a manner known per se in cooperation with a stationary die 27 fixed to a bolster 26 which in turn is fixed to the inner bottom surface of the base portion 1*b*.

The actuating shaft 13E projected downwardly from the third cam follower slide 11E disposed between the first and second can follower slides 11C and 11D also extend through a thorugh hole 16E formed in the partition wall 3. This actuating shaft, however, is not connected to the actuating slide 24 so that the third cam follower slide 11E can reciprocate up and down independently of other two cam follower slides 11C and 11D. The actuating shafts 13C, 13D and 13E projecting downwardly from the cam follower slides 11C, 11D and 11E are slidably supported by metals 17C, 17D and 17E which are fitted in respective through holes 16C, 16D and 16E. The open end of the through hole 16E receiving the actuating shaft 13E of the third cam follower slide 11E, adjacent the frame base 1*b*, is converted by a cover 38.

The first to third cam follower slides 11C, 11D and 11E have upper and lower rollers 22C, 22D and 22E and 23C, 23D and 23E which are rotatably carried by a pair of vertically spaced horizontal shafts 20C, 20D and 20E and 21C, 21D and 21E. These rollers are held in contact with corresponding cams so that the cam follower slides are moved reciprocatingly and vertically as these cams are rotated as a result of rotation of the input shaft 4.

The first cam 10C and the second cam 10D are set at the same phase, so that they take the same rotational position at the same time as shown in FIG. 6. On the other hand, the third cam 10E is set at 180° phase difference from the first and second cams such that, when one of the apices of each of the first and second cams 10C and 10D is held in contact with the lower roller 23C or 23D, the corresponding apex of the third cam 10E is spaced 180° from the above-mentioned apices of the first and second cams. Therefore, when the first and second cam follower slides 11C and 11D are lowered by the action of the first and second cams 10C and 10D as shown in FIGS. 5 and 6, the third cam 10E lifts its associated cam follower slide 11E. Thus, the third cam follower slide 11E reciprocates at a timing which is inverted from the timing of the first and second cam follower slides 11C and 11D.

As will be seen from FIG. 6, a weight 46 is attached to each side of the third cam follower slide 11E. The mass of the weight 46 is selected such that the total weight of the third cam follower slide 11E including the weights 46 equals to the total mass of the first and second cams 10C, 10D, first and second cam follower slides 11C, 11D and the actuating slide 24 carrying the movable die 25. In consequence, a dynamic balance of mass is obtained by virture of inversion of the operation timing between the first and second cams and the third cam. In FIG. 6, it may appear that the weights 46 are attached to the sides of the second cam follower slide. Actually, however, this is not correct and the weights 46 are attached, as explained before, to the sides of the third cam follower slide 11E which has an identical configuration as the second cam follower slide 11D and, hence, just hidden behind the latter, and only the weights 46 attached to the third cam follower slide are visible. The die attached to the actuating slide 24 may be varied in accordance with the kind of the press work to be conducted, resulting in a change in the weight or mass of the moving parts. In order to attain good dynamic balance of the mass, therefore, the weights 46 are preferably detachable, so that they may be replaced easily with other sets of weight having different values of mass.

In order to obtain the dynamic balance of the press machine, it is desirable that the strokes and weights of the slides are selected to meet the following conditions.

$$W_7 = W_5 + W_6;$$

$$S_1(W_1 + W_2 + W_3 + W_4) = S_2 W_7;$$

$$S_1 = S_2$$

where, $W_1$, $W_2$ and $W_3$ represent the weights of the first cam follower slide, second cam follower slide and the actuating slide, $W_4$ represents the weight of the moving die, $W_5$ represents the weight of the third cam follower slide, $W_6$ represents the total weight of the weights, $W_7$ represents the total weight of all constituents except the third cam follower slide and the weights, $S_1$ represents the stroke of the actuating slide and $S_2$ represents the stroke of the third cam follower slide. All the weights are represented in terms of kg, while the strokes are given by mm.

As will be understood from the foregoing description, in the third embodiment of the invention, the third cam follower slide operates in a timing which is inverted from that of the first and second cam follower slides, so that the inertia or vibratory force produced by the actuating slide in the direction of movement thereof is balanced by the inertia or vibratory force which is produced by the third cam follower slide including the weights. It is thus possible to attain a dynamic balance in the direction of movement of the slides and also to minimize any unbalance of force acting in the direction of rotation of the input shaft. Consequently, the wear of bearings is suppressed such as to attain a longer life of the press machine, while assuring a high precision of the press work.

What is claimed is:

1. A press machine comprising:

a frame;

a horizontal input shaft rotatably carried by said frame rotationally driven by a driving system;

a cam means including at least one cam mounted on said input shaft;

a cam follower means including a cam follower slide embracing said cam and mounted on said frame for free vertical movement, said cam follower slide being adapted to be moved reciprocatingly up and down in accordance with the rotation of said cam;

a movable die portion fixed to the lower end of said cam follower slide; and a stationary die portion provided on the bottom of said frame for cooperation with said movable die portion;

wherein said cam has a contour which approximates a spherical regular polygon having $2n+1$ apices (n being an integer) which are rounded, the surfaces of the sides of said spherical regular polygon being formed by the same curve, and wherein said cam slide includes a hub projecting upwardly from the top thereof and a shaft projecting downwardly from the bottom thereof, said hub and said shaft being supported vertically slidably by means of metals mounted on said frame.

2. A press machine according to claim 1, wherein said cam means includes a plurality of cams mounted on said input shaft and having an identical contour and said cam follower means includes a plurality of cam follower slides corresponding to said cams, said cam follower slides being connected commonly to said movable die portion.

3. A press machine according to claim 2, wherein each of said cam follower slides includes a hub projecting upwardly from the top thereof and a shaft projecting downwardly from the bottom thereof, said hub and said shaft of each cam follower slide being supported vertically slidably by means of metals mounted on said frame.

4. A press machine comprising:

a frame;

a horizontal input shaft rotatably carried by said frame and rotationally driven by a driving system;

a cam means including first, second and third cams mounted on said input shaft and spaced from each other in the direction of the axis of rotation of said input shaft with said third cam disposed between said first and second cams;

a cam follower means including first, second and third cam follower slides associated with and embracing said first, second and third cams respectively, each of said cam follower slides being mounted on said frame for free vertical movement and adapted to be moved reciprocatingly up and down in accordance with the rotation of its associated cam;

a movable die portion connected to the lower ends of said first and second cam follower slides; and a stationary die portion provided on the bottom of said frame for cooperation with said movable die portion;

wherein said cams have identical contours which approxmate a spherical regular polygon having $2n+1$ apices (n being an integer) which are rounged, the surface of the sides of said spherical regular polygon being formed by the same curve, wherein said first cam and said second cam are arranged such that their apices are aligned in the direction of said axis of said input shaft, and said third cam is arranged such that its apices are rotated 180° from the position of the corresponding apices of said first and second cams as viewed in the direction of rotation of said input shaft, wherein said third cam follower slide is separated from said movable die portion such that it is moved up and down independently of said first and second cam follower slides, and wherein said third cam follower slide is provided with a weight so that the total weight of said third cam follower slide including said weight equals to the total weight of said first and second cam follower slides, said movable die portion and other associated moving parts connected to said first and second cam follower slides.

5. A press machine according to claim 4, wherein each of said cam follower slides includes a hub projecting upwardly from the top thereof and a shaft projecting downwardly from the bottom thereof, said hub and said shaft of each cam follower slide being supported vertically slidably by means of metals mounted on said frame.

* * * * *